US008965267B2

(12) United States Patent
Cheng

(10) Patent No.: US 8,965,267 B2
(45) Date of Patent: Feb. 24, 2015

(54) IMAGE FORMING APPARATUS AND STORAGE DEVICE

(75) Inventor: Fei Cheng, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 348 days.

(21) Appl. No.: 13/601,376

(22) Filed: Aug. 31, 2012

(65) Prior Publication Data

US 2013/0058692 A1 Mar. 7, 2013

(30) Foreign Application Priority Data

Sep. 2, 2011 (JP) ..... 2011-191759

(51) Int. Cl.
*G03G 15/00* (2006.01)

(52) U.S. Cl.
CPC ..... *G03G 15/55* (2013.01); *G03G 15/6529* (2013.01); *G03G 2215/00556* (2013.01)
USPC ..... 399/400; 399/27

(58) Field of Classification Search
USPC ..... 399/400
See application file for complete search history.

(56) References Cited

U.S. PATENT DOCUMENTS 6,792,216 B2 * 9/2004 Wachter et al. ..... 399/8
8,208,820 B2 * 6/2012 Togami ..... 399/27
8,369,748 B2 * 2/2013 Ueno et al. ..... 399/227
2005/0276619 A1 * 12/2005 Taguchi et al. ..... 399/27
2006/0171747 A1 8/2006 Ishii
2009/0311024 A1 * 12/2009 Bandholz et al. ..... 400/223

FOREIGN PATENT DOCUMENTS

JP 2006-209010 A 8/2006
JP 2007-171573 A 7/2007
JP 2009-020465 A 1/2009
JP 2010-002667 A 1/2010
JP 2011-008159 A 1/2011

* cited by examiner

*Primary Examiner* — Anthony Nguyen
(74) *Attorney, Agent, or Firm* — Merchant & Gould PC

(57) ABSTRACT

An image forming apparatus including: a conveyance unit configured to convey a sheet; a printing unit configured to drive a developing device accommodating developer therein, supply the developer from the developing device to a photosensitive member having an electrostatic latent image formed thereon to thus form a developer image, and transfer the developer image onto the sheet, in accordance with the conveyance of the sheet by the conveyance unit; a first acquisition unit configured to acquire a remaining life span of the developing device based on a driving amount of the developing device; and an adjusting unit configured to adjust a distance between the sheets being conveyed by the conveyance unit based on the remaining life span of the developing device acquired by the first acquisition unit.

14 Claims, 10 Drawing Sheets

IMAGE FORMING APPARATUS AND STORAGE DEVICE

CROSS-REFERENCE TO RELATED APPLICATIONS

This application claims priority from Japanese Patent Application No. 2011-191759 filed on Sep. 2, 2011, the entire contents of which are incorporated herein by reference.

TECHNICAL FIELD

Aspects of the invention relates to a technology of controlling an image forming apparatus of an electrophotographic type that forms an image by using a developing device.

BACKGROUND

A general image forming apparatus of an electrophotographic type has a configuration where toner as developer is supplied to a photosensitive member having an electrostatic latent image formed thereon and a toner image is thus formed and is transferred and fixed on a sheet such as printing sheet. The developing device has a toner accommodation part that accommodates therein toner, an agitator that stirs the toner in the toner accommodation part, a developing roller that supplies the toner to a photosensitive drum, a supply roller that supplies the toner to the developing roller, and the like. The agitator, the developing roller and the supply roller are rotated as the sheet is conveyed (see, for example, JP-A-2006-209010).

SUMMARY

When the developing device is driven for a long time, the toner is deteriorated due to friction or stirring and the parts such as rollers are worn, so that it may be necessary to replace the developing device before the toner is used up.

Aspects of the invention have been made to solve the above-described problem. An object of the invention is to provide to a technology of adjusting a life span of a developing device.

According to an aspect of the invention, there is provided an image forming apparatus including: a conveyance unit configured to convey a sheet; a printing unit configured to drive a developing device accommodating developer therein, supply the developer from the developing device to a photosensitive member having an electrostatic latent image formed thereon to thus form a developer image, and transfer the developer image onto the sheet, in accordance with the conveyance of the sheet by the conveyance unit; a first acquisition unit configured to acquire a remaining life span of the developing device based on a driving amount of the developing device, and an adjusting unit configured to adjust a distance between the sheets being conveyed by the conveyance unit based on the remaining life span of the developing device acquired by the first acquisition unit.

According to another aspect of the invention, there is provided an image forming apparatus including: a conveyance unit configured to convey sheets while leaving a distance between the sheets; a printing unit configured to drive a developing device accommodating developer therein, supply the developer from the developing device to a photosensitive member having an electrostatic latent image formed thereon to thus form a developer image, and transfer the developer image onto the sheet, in accordance with the conveyance of the sheet by the conveyance unit; a first calculating unit configured to calculate a change rate of a remaining life span of the developing device based on a driving amount of the developing device; a second calculating unit configured to calculate a change rate of a remaining amount of the developer in the developing device; and an adjusting unit configured to: adjust the distance between the sheets conveyed by the conveyance unit to a first distance if a size of the sheets are larger than a predetermined size, adjust the distance between the sheets conveyed by the conveyance unit to a second distance, which is smaller than the first distance, if the size of the sheets are not larger than the predetermined size and the change rate of the remaining life span of the developing device is not larger than the change rate of the remaining amount of the developer, and adjust the distance between the sheets conveyed by the conveyance unit to a third distance, which is smaller than the second distance, if the size of the sheets are not larger than the predetermined size and the change rate of the remaining life span of the developing device is larger than the change rate of the remaining amount of the developer.

Further, the invention can be implemented in a variety of aspects, for example, an image forming apparatus, an image forming system having the image forming apparatus and a terminal apparatus, a control method of the image forming apparatus, a computer program for implementing the apparatus, system functions or method, a storage device having the computer program recorded therein, and the like.

According to the invention, it is possible to adjust the distance between the sheets being conveyed based on the remaining life span of the developing device, and to thus change the driving amount of the developing device, thereby adjusting the life span of the developing device.

DETAILED DESCRIPTION

<First Illustrative Embodiment>

In the below, a first illustrative embodiment of the invention will be described with reference to FIGS. 1 to 8.

(Overall Configuration of Printer)

Figure 1:
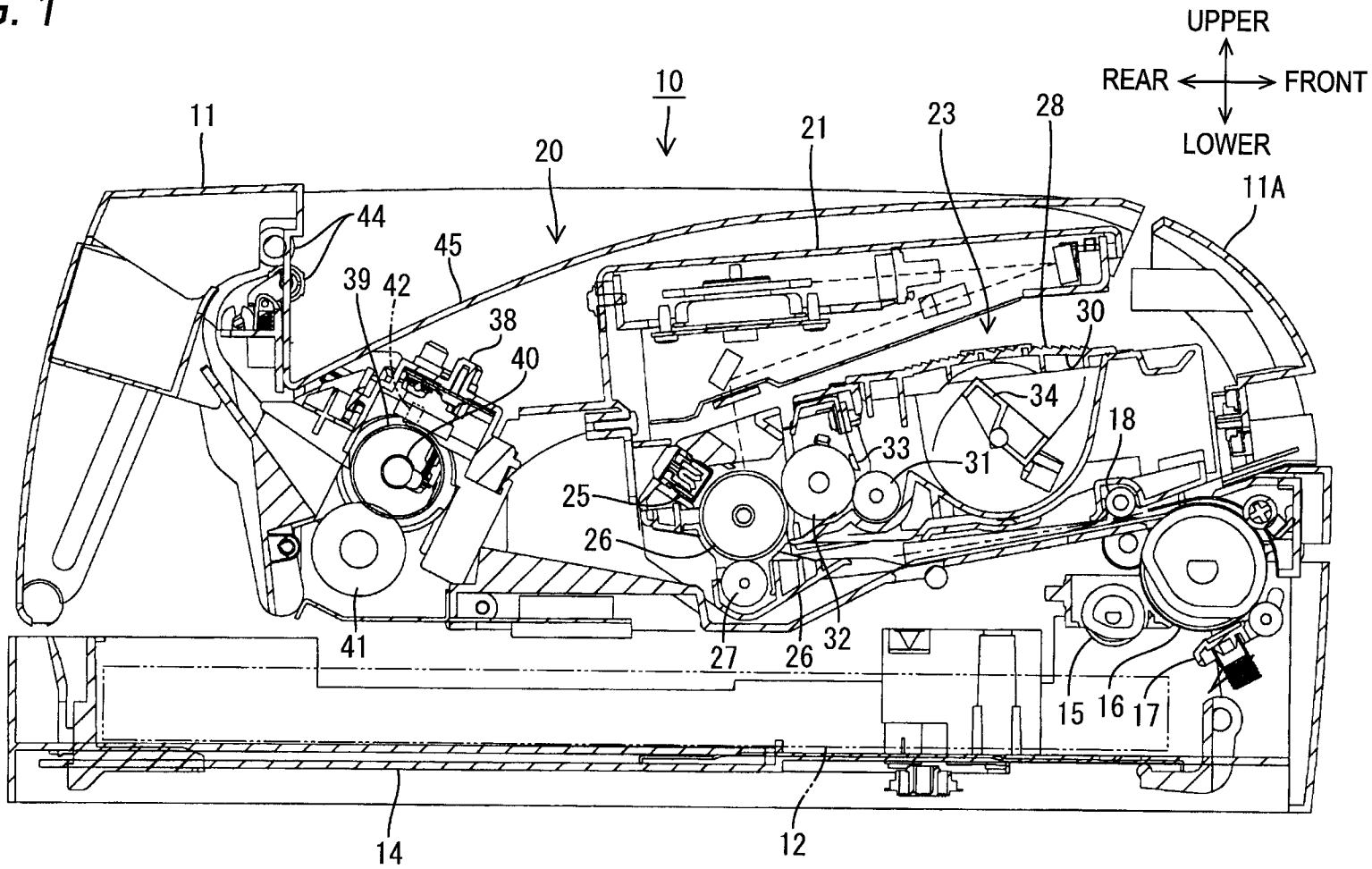
FIG. 1 is a side sectional view schematically showing a configuration of a printer according to first to third illustrative embodiments.

FIG. 1 is a side sectional view schematically showing a configuration of a printer 10. The printer 10, which is an example of the image forming apparatus, is a laser printer of an electrophotographic type. For reference, in the following descriptions, the right side of FIG. 1 is referred to as the front side.

The printer 10 has a body casing 11 and an openable front face cover 11A at a front face of the body casing 11. A feeding tray 14 that can stack therein a plurality of sheets 12 (sheet, OHP sheet and the like) is provided at a bottom part of the body casing 11. The uppermost sheet 12 in the feeding tray 14 is sent forward by a pickup roller 15. When the sheets are interposed between a supply roller 16 and a separation pad 17, the sheets are processed one by one, which is then conveyed to a registration roller 18 by the supply roller 16. Also, the registration roller 18 conveys the sheet 12 to a printing unit 20.

The printing unit 20 has an exposure unit 21, a process cartridge 23 and a fixing device 38.

The exposure unit 21 illuminates a laser light whose emission is controlled in response to printing data onto a photosensitive drum 26 that will be described later.

By opening the front face cover 11A, the process cartridge 23 can be attached to and detached from the body casing 11. The process cartridge 23 has a charger 25 attached to a frame 24, the photosensitive drum 26, a transfer roller 27, the registration roller 18 and a developing device 28 that can be attached to and detached from the frame 24.

The charger 25 is a scorotron-type charger, for example, and generates a corona discharge from a wire for discharge made of tungsten and the like. The photosensitive drum 26 is configured by covering an outer periphery of an earthed metal tube having a cylindrical shape with a positively chargeable photosensitive layer made of polycarbonate and the like. The transfer roller 27 has an outer periphery part made of a conductive rubber material and the sheet 12 is fed between the photosensitive drum 26 and the transfer roller 27.

The developing device 28 has a toner accommodation part 30, a toner supply roller 31, a developing roller 32, a thickness regulation blade 33 and an agitator 34. The toner accommodation part 30 accommodates, as developer, a non-magnetic toner of one component that has each color and is positively chargeable, for example. The toner supply roller 31 has an outer periphery part made of a foamed elastic member and is provided below the toner accommodation part 30.

The developing roller 32 has an outer periphery part made of an elastic member such as conductive silicon rubber and is provided with being in contact with the toner supply roller 31 below the toner accommodation part 30. The thickness regulation blade 30 has a configuration where an elastic member such as silicon rubber is attached to a leading end portion of a plate spring, and a leading end portion of the blade is in contact with a surface of the developing roller 32. The agitator 34 is provided in the toner accommodation part 30 and is rotated to stir the toner in the toner accommodation part 30.

When forming an image, the agitator 34 is rotated to push out the toner in the toner accommodation part 30 toward the supply roller 31. As the toner supply roller 31 is rotated, the toner is supplied to the developing roller 32 and is positively friction-charged between the toner supply roller 31 and the developing roller 32. As the developing roller 32 is rotated, the toner on the developing roller 32 is introduced between a leading end portion of the thickness regulation blade 33 and the developing roller 32 and is further sufficiently friction-charged at that point, thereby forming a thin film having a predetermined thickness.

Also, as the photosensitive drum 26 is rotated, a surface of the photosensitive drum 26 is positively charged by the charger 26. The positively charged part is exposed by the laser light emitted from the exposure unit 21, so that an electrostatic latent image is formed on the surface of the photosensitive drum 26.

Also, as the developing roller 32 is rotated, the toner that is supported by the developing roller 32 and is positively charged is supplied to the electrostatic latent image on the photosensitive drum 26. Thereby, the toner is supplied to the exposed part on the photosensitive drum 26 so that the electrostatic image on the photosensitive drum 26 becomes visible toner image.

Then, while the sheet 12 passes between the photosensitive drum 26 and the transfer roller 27, the toner image supported by the photosensitive drum 26 is transferred to the sheet 12 by a negative transfer voltage applied to the transfer roller 27. The sheet 12 having the toner image transferred thereto is conveyed to the fixing device 38.

The fixing device 38 has a fixing roller 39, a heater 40, a pressing roller 41 and a temperature sensor 42. The fixing roller 39 includes a cylindrical metal tube and has therein the heater 40 such as halogen lamp that is arranged along an axis direction of the fixing roller 39. The pressing roller 41 has an outer periphery part made of an elastic member such as heat-resistant rubber and is urged toward the fixing roller 39. The temperature sensor 42 is a thermistor, for example, and is arranged in the vicinity of an axially central portion of the fixing roller 39 and detects a temperature of an outer periphery of the fixing roller 39.

As described above, the temperature of the fixing roller 39 of the fixing device 38 is controlled as the heater 40 is turned on/off based on the temperature detected by the temperature sensor 42. Also, while the sheet 12 having the toner image transferred thereto passes a fixing position between the fixing roller 39 and the pressing roller 41, the fixing device 38 heats the sheet 12 and thus fixes the toner image.

The sheet 12 having passed through the fixing device 38 is discharged to a discharge tray 45, which is formed on an upper surface of the body casing 11, by discharge rollers 44.

(Electrical Configurations of Printer and Terminal Apparatus)

Figure 2:
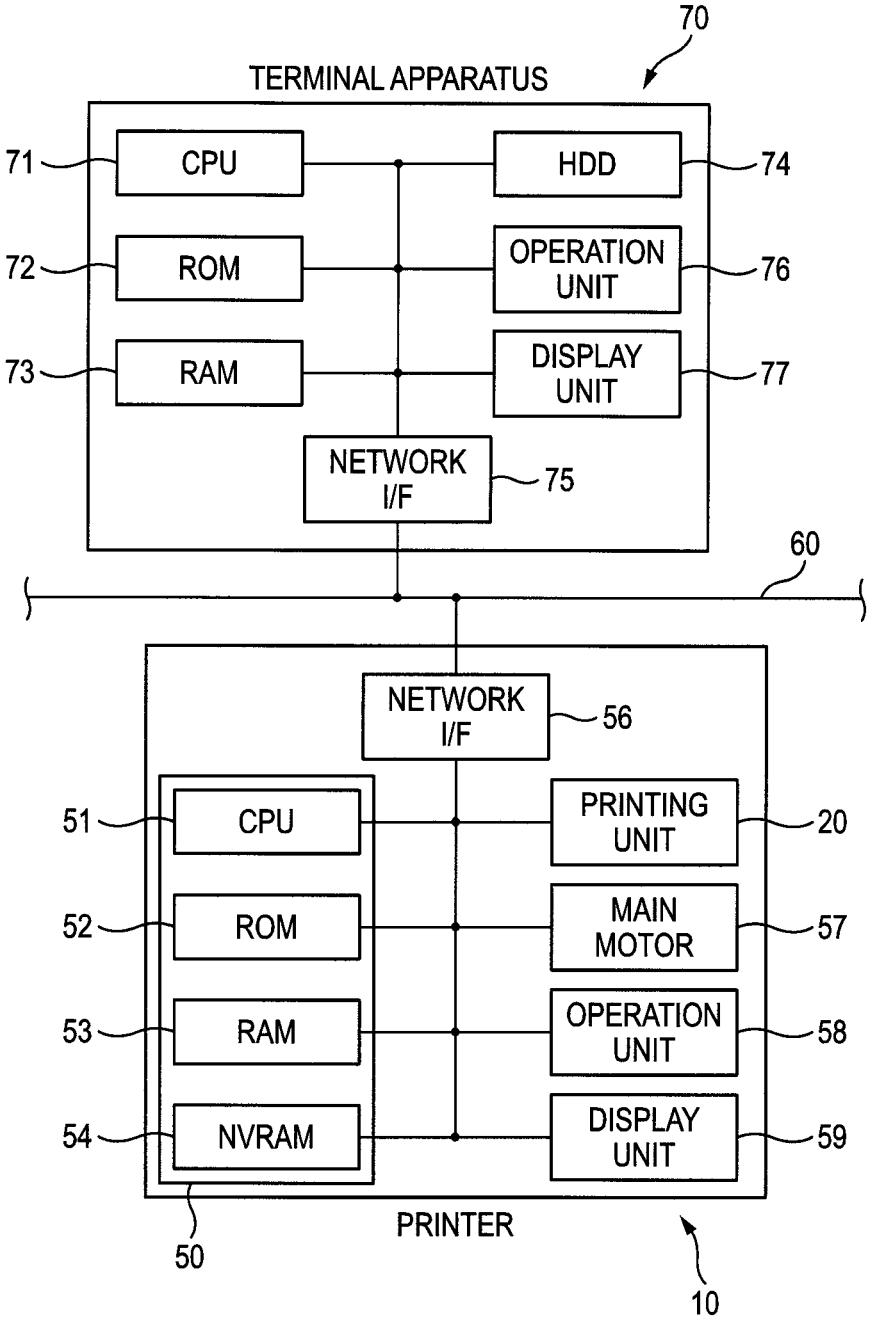
FIG. 2 is a block diagram schematically showing electrical configurations of the printer and a terminal apparatus according to the first to third illustrative embodiments.

FIG. 2 is a block diagram schematically showing electrical configurations of the printer 10 and a terminal apparatus 70.

The printer 10 includes a control unit 50, a network interface 56, a main motor 57, an operation unit 58, a display unit 59 and the like, in addition to the printing unit 20.

The control unit 50 consists of an application specific integrated circuit (ASIC) and has a Central Processing Unit (CPU) 51, a Read Only Memory (ROM) 52, a Random Access Memory (RAM) 53, a Non-Volatile Random Access Memory (NVRAM) 54 and the like. The ROM 52 stores therein control programs for executing various operations of the printer 10, such as printing control processing and the like that will be described later. The CPU 51 (which is an example of the first acquisition unit, the adjusting unit and the second acquisition unit) controls operations of the respective parts in response to programs read out from the ROM 52. The RAM 53 is a volatile memory that is used as a work area of the CPU 51, and the NVRAM 54 is a non-volatile memory that stores various setting values and the like.

The network interface 56 is connected to a communication line 60 such as LAN and performs communication with the terminal apparatus 70 and the like connected on the communication line 60.

The main motor 57 synchronously rotates the pickup roller 15, the supply roller 16, the registration roller 18, the photosensitive drum 26, the toner supply roller 31, the developing roller 32, the agitator 34, the fixing roller 39, the discharge rollers 44 and the like by a power transmission mechanism consisting of a gear, a pulley, a belt and the like, which are not shown. Also, the main motor 57 and the pickup roller 15, the supply roller 16, the registration roller 18, the photosensitive drum 26, the fixing roller 39, the discharge rollers 44 and the like, which are driven by the main motor, correspond to the conveyance unit that conveys the sheet 12. The toner supply roller 31, the developing roller 32 and the agitator 34 of the developing device 28 are driven at speeds proportional to the conveyance speed of the sheet 12 by the conveyance unit.

The operation unit 58 has a plurality of buttons and receives inputs of various instructions by the user. The display unit 59 has a display, a lamp and the like and displays a variety of messages, setting screens and the like.

The terminal apparatus 70 has a Central Processing Unit (CPU) 71, a Read Only Memory (ROM) 72, a Random Access Memory (RAM) 73, a Hard Disk Drive (HDD) 74, a network interface 75, an operation unit 76, a display unit 77 and the like. The ROM 72 stores therein programs such as BIOS (Basic Input/Output System). The HDD 74 stores therein a variety of programs such as OS, application capable of preparing image data, printer driver and the like. The CPU 71 controls operations of the terminal apparatus 70 while storing processing results in the RAM 73 or HDD 74, in response to the programs read out from the ROM 72 or HDD 74.

The network interface 75 is connected to the communication line 60. The operation unit 76 has a keyboard, a pointing device and the like. A user can input various instructions to the CPU 71 by using the operation unit 76. The display unit 77 has a display and displays a variety of images under control of the CPU 71.

(Printing Control Processing)

Figure 3:
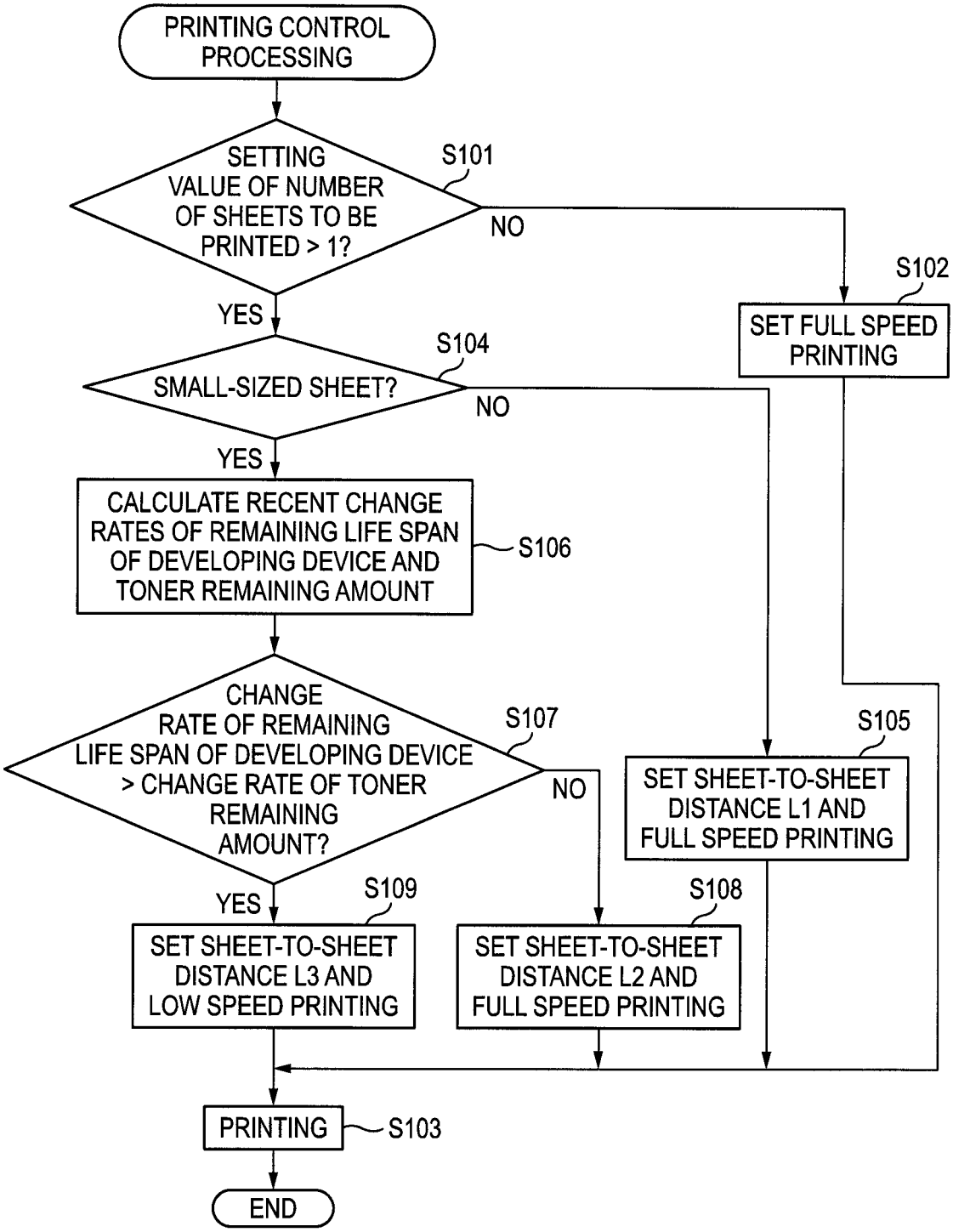
FIG. 3 is a flowchart showing printing control processing of the first illustrative embodiment.

Hereinafter, a printing control processing operation for controlling a distance between the sheets 12 at the time of execution of a printing job is described. FIG. 3 is a flowchart showing the printing control processing.

When a user starts an application for preparing a document or image with the terminal apparatus 70 and inputs an instruction to execute a printing job through the operation unit 76, the CPU 71 generates printing data by functions of the printer driver and transmits the printing data to the printer 10 through the network interface 75 together with the setting values of various printing conditions such as the number of sheets to be printed, a size of the sheet 12 to be printed (hereinafter, referred to as sheet size) and the like.

When the CPU 51 of the printer 10 receives the printing data through the network interface 56, the CPU registers the printing data on a queue that is configured on the RAM 53, as a printing job, and executes the printing control processing.

In the printing control processing of FIG. 3, the CPU 51 first determines whether the printing job is a printing job for a plurality of sheets 12, based on the setting value of the number of sheets to be printed, which is included in the printing data (S101). That is, in S101, the CPU 51 determines whether the setting value of the number of sheets to be printed is larger than one. When the printing job is a printing for one sheet 12 (S101: NO), the CPU sets full speed as the printing speed, i.e., the conveyance speed of the sheet 12 at the time of printing (S102).

Also, in this illustrative embodiment, the conveyance speed of the sheet 12 by the main motor 57 can be set with one of 'full speed' and 'low speed' slower than the full speed. After setting the printing speed to the full speed, the CPU 51 sends the sheet 12 from the feeding tray 14 by the main motor 57 and prints an image based on the printing data on the sheet 12 (S103).

When the printing job is a printing for a plurality of sheets 12 (S101: YES), the CPU 51 determines whether the printing job is a printing job for a small-sized sheet 12, based on the setting value of the sheet size (S104). Also, in this illustrative embodiment, the sheets 12 of two types, i.e., normal size and small size are used. At least a width size of the small-sized sheet 12 is smaller than that of the normal-sized sheet 12.

Figure 4:
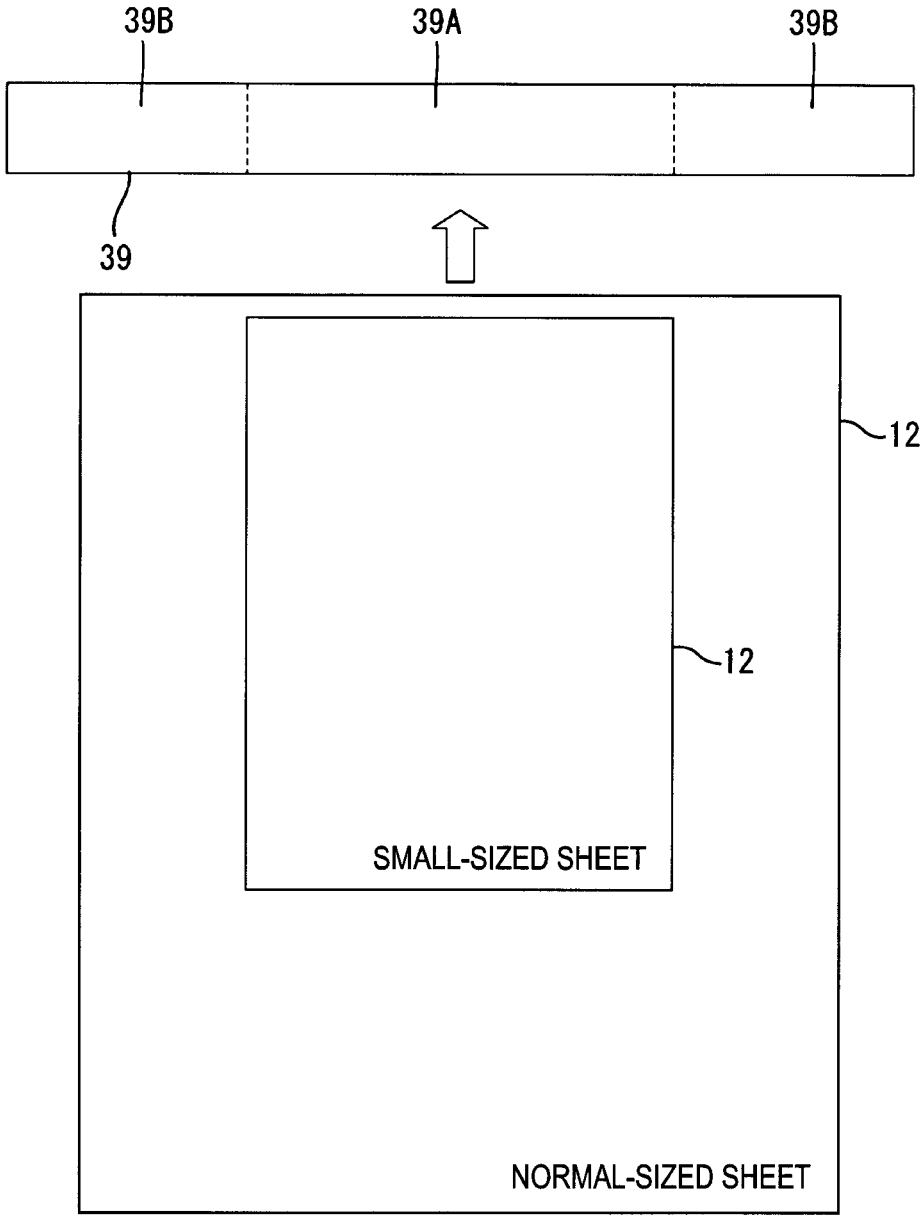
FIG. 4 is a pictorial view showing a relation between a fixing roller and a small-sized sheet in the first and second illustrative embodiments.

Here, FIG. 4 is a pictorial view showing a relation between the fixing roller 39 and the small-sized sheet 12. The normal-sized sheet 12 has a width size that is slightly smaller than an axial length of the fixing roller 39. The normal-sized sheet 12 is brought into contact with a central portion 39A (an inner part of a pair of dotted lines in FIG. 4) and most of both end portions 39B of the fixing roller 39B, when passing the fixing position. Compared to this, the small-sized sheet 12 is brought into contact with the central portion 39A and is not in contact with the both end portions 39B of the fixing roller 39, when passing the fixing position.

Also, the sheet size may be obtained as follows. That is, the user may input a size of the sheet 12 to be loaded in the feeding tray 14 through the operation unit 58 and store the size in the NVRAM 54 in advance and the CPU 51 may read out the size from the NVRAM 54. Also, the sheet size may be obtained by detecting a position of a moveable guide provided to the feeding tray 14 or by detecting a position of the sheet 12 with an optical sensor and the like.

When it is determined that the sheet 12 has the normal size, rather than the small size (S104: NO), the CPU 51 sets a distance L1 as a distance between the sheets 12 (hereinafter, referred to as sheet-to-sheet distance), which are continuously printed at the time of printing, and full speed as the printing speed (S105), and proceeds to S103 and prints all pages of the printing job, based on the settings.

Figure 5:
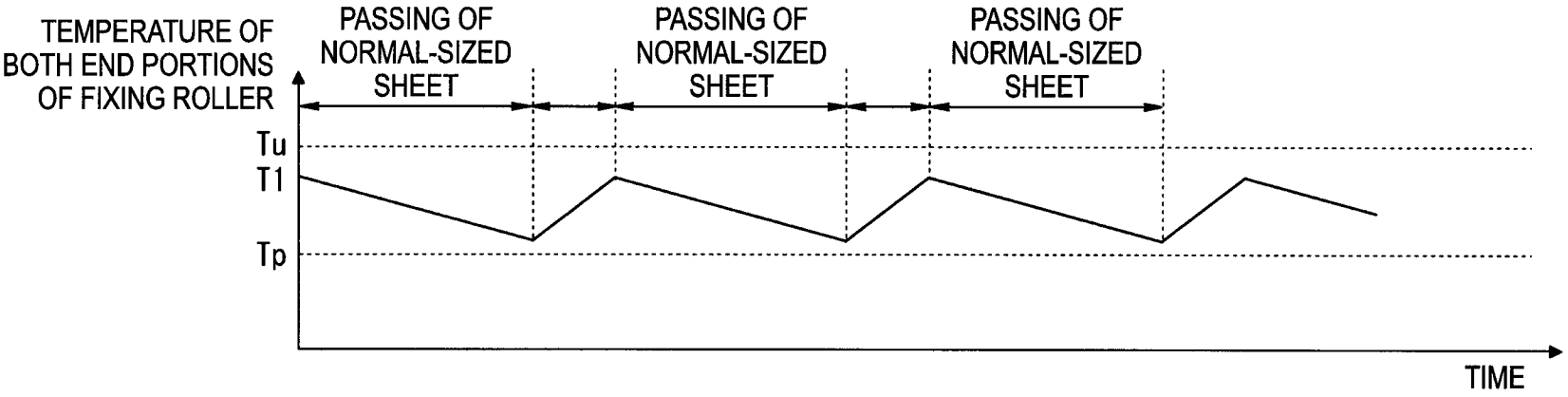
FIG. 5 is a graph showing a change in temperature of both end portions of the fixing roller when performing full speed printing for a normal-sized sheet in the first illustrative embodiment.

Here, FIG. 5 is a graph showing a change in temperature of both end portions 39B of the fixing roller 39 when performing the printing job for the normal-sized sheet 12. When starting the printing, the CPU 51 sets a temperature T1 as a target temperature of the fixing device 38 and controls the temperature of the fixing roller 39 so that it approximates to the target temperature T1, before a leading end of the first sheet 12 reaches the fixing position of the fixing device 38.

The target temperature T1 is a predetermined temperature that is higher than a fixing temperature Tp at which the toner is fused and lower than an upper limit temperature Tu. Specifically, the CPU 51 sets an upper limit value that is slightly higher than the target temperature and a lower limit value that is slightly lower than the target temperature. When the temperature of the fixing roller 39 detected by the temperature sensor 42 is equal to or lower than the lower limit value, the CPU turns on the heater 40 and when the temperature of the fixing roller is equal to or higher than the upper limit value, the CPU turns off the heater 40, thereby controlling the temperature of the fixing roller 39 so that it is close to the target temperature.

While the sheet 12 having the toner image formed thereon reaches the fixing device 38 and passes the fixing position, the heat of the fixing roller 39 is absorbed by the sheet 12. At this time, since the normal-sized sheet 12 is in contact with the central portion 39A and most of the both end portions 39B of the fixing roller 39, the temperatures of central portion 39A and both end portions 39B are gradually lowered while the sheet 12 passes thereto, as shown in FIG. 5.

When the normal-sized sheet 12 has passed to the fixing position, since the heat of the fixing roller 39 is not absorbed by the sheet 12, the temperature of the fixing roller 39 is increased. Also, before a leading end of a next sheet 12 reaches the fixing position, the temperature of the fixing roller 39 is increased to around the target temperature T1. When the leading end of the next sheet 12 reaches the fixing position, the temperature of the fixing roller is again lowered.

The sheet-to-sheet distance L1 is the substantially same as a value that is obtained by multiplying the conveyance speed of the sheet 12 by time form when a rear end of the previous sheet 12 passes the fixing position until the temperature of the fixing roller is increased to around the target temperature T1. The CPU 51 controls the operations of the pickup roller 15 and the supply roller 16 and thus adjusts timing to send out each sheet 12 so that the sheet-to-sheet distance becomes the distance L1.

Also, when the printing job is a printing for the small-sized sheet 12 (S104: YES), the CPU 51 calculates a change rate of a remaining life span of the developing device 28 and a change rate of a toner remaining amount in a time period during which 2,000 sheets have been recently printed, for example (S106).

Here, the life span of the developing device 28 is a life span depending on a driving amount of the developing device 28, and in this illustrative embodiment, is expressed by the number of rotations of the developing roller 32. That is, as the developing device 28 is driven, the toner is subject to friction between the developing roller 32 and the toner supply roller 31 or between the developing device 28 and the thickness regulation blade 33 or is stirred by the agitator 34. Thereby, the life span is determined, based on the degree that the charging capability of the toner is deteriorated.

In addition to the degree of the deterioration of the toner, the life span of the developing device 28 can be determined depending on degrees of deterioration of the parts such as the toner supply roller 31, the developing roller 32, the thickness regulation blade 33 and the agitator 34 due to the wear.

When driving the developing device 28, the CPU 51 counts the number of rotations of the developing roller 32, based on the number of rotations of the main motor 57 and the like, and stores the accumulated number of rotations from the beginning of use of the developing device 28 to the current, based on the count. Also, the useable number of rotations of the developing roller 32, which is a number of rotations from a new product state of the developing device 28 to a state thereof where it is necessary to replace the developing device, is stored in the NVRAM 54, as the original life span of the developing device 28.

In S106, the CPU 51 reads out the useable number of rotations of the developing roller 32 and the accumulated number of rotations of the developing roller 32 from the NVRAM 54 and calculates a difference therebetween, as the remaining life span of the developing device 28.

Also, the CPU 51 stores a relation between the remaining life span of the developing device 28 and the accumulated number of printed sheets in the NVRAM 54, as needed, in a time period during which at least 2,000 sheets have been recently printed. Then, in S106, the CPU reads out the information from the NVRAM 54 and calculates a ratio of the remaining life span to the original life span of the developing device 28 and a change rate thereof in the time period during which at least 2,000 sheets have been recently printed. For example, when the ratio of the current remaining life span is 50% and the ratio of the remaining life span at which the accumulated number of sheets is smaller than 2,000 sheets is 70%, the change rate of the remaining life span per printed sheet is 0.01 (=(70−50)/2000).

In this illustrative embodiment, the toner amount of the developing device 28 can be expressed by using the number of printing dots. In the NVRAM 54, the number of printing dots, which can be used from a state where the toner is filled in the developing device 28 to a state where it is necessary to replace the developing device, is beforehand stored as the original toner amount of the developing device 28. Also, the CPU 51 counts the number of printing dots whenever performing the printing, and stores the accumulated number of printed dots from the beginning of use of the developing device 28 in the NVRAM 54.

In S106, the CPU 51 reads out the useable number of printing dots and the accumulated number of printed dots of the developing device 28 from the NVRAM 54, and calculates a ratio of the useable number of printing dots, which is a difference therebetween, as a ratio of the remaining amount to the original toner amount.

Further, the CPU 51 stores a relation between the toner remaining amount and the accumulated number of printed sheets in the NVRAM 54, as needed, in the time period during which at least 2,000 sheets have been recently printed, reads out the information and thus calculates a change rate of the time period during which the recent 2,000 sheets have been printed, which is a ratio of the toner remaining amount to the original toner amount.

Also, the CPU 51 calculates the remaining life span and the toner remaining amount of the developing device 28, as needed, separately from the printing control processing, and compares the same with thresholds, respectively. When at least one of the remaining life span and the toner remaining amount is smaller than the threshold, the CPU displays a message on the display unit 59, which urges the user to replace the developing device 28. Furthermore, when the developing device 28 is replaced, the counts of the accumulated number of printed dots corresponding to the developing device 28 and the accumulated number of rotations of the developing device 32, which are stored in the NVRAM 54, are set to be zero, respectively.

After calculating the change rate of the remaining life span of the developing device 28 and the change rate of the toner remaining amount in S106, the CPU 51 determines whether the change rate of the remaining life span is larger than the change rate of the toner remaining amount (S107). When the change rate of the remaining life span is equal to or smaller than the change rate of the toner remaining amount (S107: NO), the CPU sets the distance L2 larger than L1 as the sheet-to-sheet distance and the full speed as the printing speed (S108). Also, the CPU prints all pages of the printing job in S103, based on the setting values, and ends the printing control processing.

Also, when the change rate of the remaining life span is larger than the change rate of the toner remaining amount (S107: YES), the CPU 51 sets the distance L3 smaller than L2 as the sheet-to-sheet distance and sets the low speed as the printing speed (S109). Also, the CPU prints all pages of the printing job in S103, based on the setting values, and ends the printing control processing.

Figure 6:
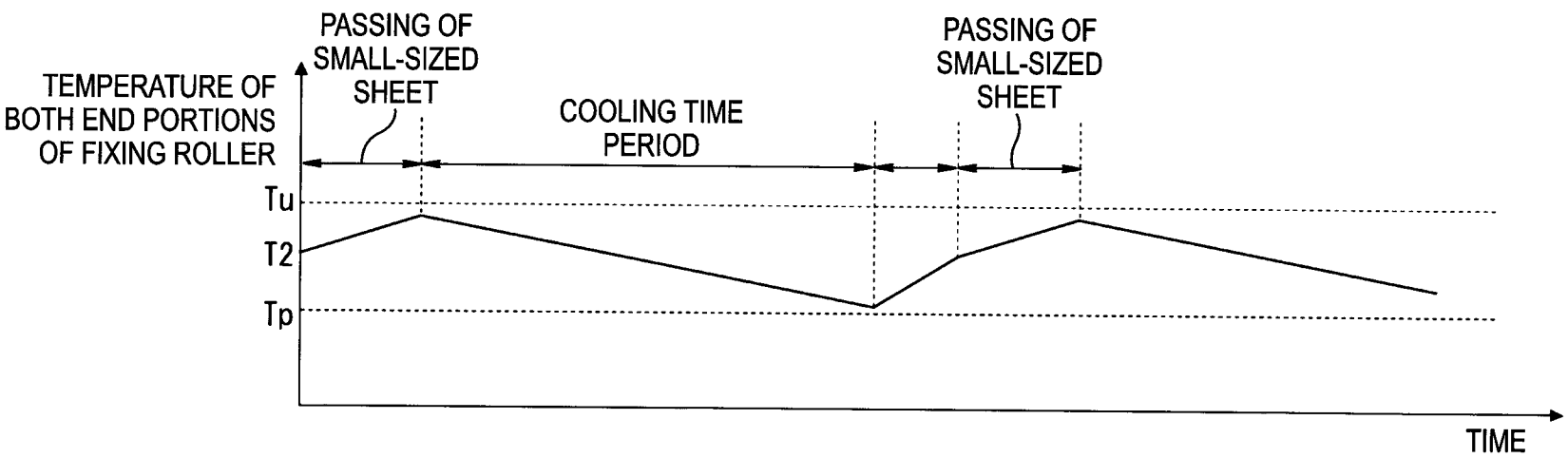
FIG. 6 is a graph showing a change in temperature of both end portions of the fixing roller when performing full speed printing for a small-sized sheet in the first illustrative embodiment.

FIG. 6 is a graph showing a change in temperature of both end portions 39B of the fixing roller 39 when performing full-speed printing for the small-sized sheet 12. When starting the printing in S103 with the distance L2 being set as the sheet-to-sheet distance and the full speed being set as the printing speed in S108, the CPU 51 sets a temperature T2 as the target temperature of the fixing device 38 and starts to heat the fixing roller 39 with the heater 40 before the leading end of the first sheet 12 reaches the fixing position. The target temperature T2 is higher than the fixing temperature Tp at which the toner is fused and lower than the upper limit temperature Tu.

While the small-sized sheet 12 reaches the fixing device 38 and passes the fixing position, the temperature of the central portion 39A of the fixing roller 39 is gradually lowered because the heat is absorbed by the sheet 12 therefrom. On the other hand, since the both end portions 39B of the fixing roller 39 are heated by the heater 40 without being heat-absorbed by the sheet 12, the temperature thereof is gradually increased, as shown in FIG. 6.

When the rear end of the small-sized sheet 12 passes the fixing position, the CPU 51 sets a cooling time period during which the heating of the fixing roller 39 by the heater 40 is stopped. That is, when the sheet-to-sheet distance is set to be L1 that is the same as the normal-sized sheet 12, for example, the next small-sized sheet 12 passes the fixing position at a state where the temperature difference between the central portion 39A and both end portions 39B of the fixing roller 39 is relatively large. Therefore, both end portions 39B are again heated, so that the temperature thereof may exceed the upper limit temperature Tu. Thus, the cooling time period is set to radiate the heat of both end portions 39B, so that it is possible to reduce the temperature difference between the central portion 39A and both end portions 39B to some extent.

When the cooling time period elapses, the CPU 51 sets the temperature T2 as the target temperature of the fixing roller 39 and again heats the fixing roller 39 with the heater 40. After the temperature of the fixing roller 39 is increased to around the temperature T2, the leading end of the next small-sized sheet 12 reaches the fixing position and the temperature of the fixing roller 39 is changed in the same manner.

The sheet-to-sheet distance L2 is substantially the same as a value that is obtained by multiplying the conveyance speed of the sheet 12 at the time of full speed printing by a sum total of the cooling time period and the time period after the cooling time period until the temperature of the fixing roller 39 is increased to around the target temperature T2.

Like this, when performing the printing job for the small-sized sheet 12, the cooling time period is provided for each sheet 12. Therefore, the time that is consumed to perform the printing job for one sheet is prolonged, compared to the case where the printing is performed for the normal-sized sheet 12. Also, the toner supply roller 31, the developing roller 32 and the agitator 34 of the developing device 28 are rotated at constant speeds while the printing job is executed. Thus, when performing the printing job for the small-sized sheet 12, the driving amount (the number of rotations of the developing roller 32) of the developing device 28 per sheet is larger, compared to the case where the printing job is performed for the normal-sized sheet 12.

Figure 7:
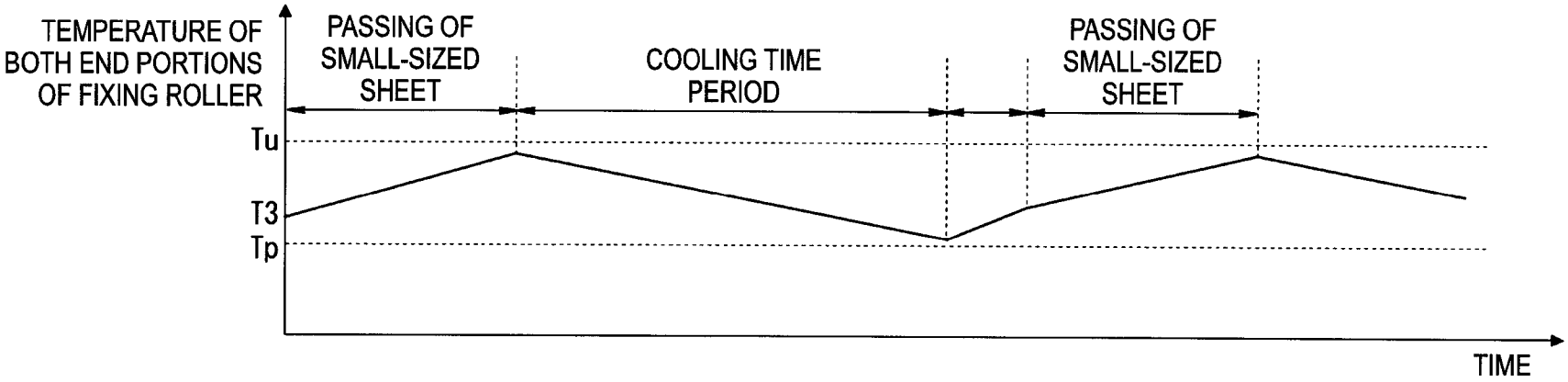
FIG. 7 is a graph showing a change in temperature of both end portions of the fixing roller when performing low speed printing for a small-sized sheet in the first illustrative embodiment.

FIG. 7 is a graph showing a change in temperature of both end portions 39B of the fixing roller 39 when performing low-speed printing for the small-sized sheet 12. When starting the printing in S103 with the distance L3 being set as the sheet-to-sheet distance and the low speed being set as the printing speed in S108 (for example, the printing speed is set to be ⅜ of the full speed), the CPU 51 sets a temperature T3 as the target temperature of the fixing device 38 and starts to heat the fixing roller 39 with the heater 40 before the leading end of the first sheet 12 reaches the fixing position. The target temperature T3 is higher than the fixing temperature Tp at which the toner is fused and lower than the temperature T2.

Before the small-sized sheet 12 reaches the fixing device 38 and passes the fixing position, the temperature of the central portion 39A of the fixing roller 39 is gradually lowered and the temperature of the both end portions 39B is increased, as described above. At this time, since the conveyance speed of the sheet 12 is low speed, the contact time during which the small-sized sheet 12 and the fixing roller 39 are in contact with each other is prolonged, compared to the full speed printing. Accordingly, the amount of heat absorbed from the fixing roller 39 to the sheet 12 per unit time is increased, compared to the full speed printing. As a result, the sheet is sufficiently fixed at the target temperature T3 lower than that of the full speed printing.

After the rear end of the small-sized sheet 12 passes the fixing position, the CPU 51 sets a cooling time period because the temperature difference between the central portion 39A and both end portions 39B of the fixing roller 39 is large. When the cooling time period elapses, the CPU 51 sets the temperature T3 as the target temperature of the fixing roller 39 and again heats the fixing roller 39 with the heater 40.

The sheet-to-sheet distance L3 is the substantially same as a value that is obtained by multiplying the conveyance speed of the sheet 12 at the time of low speed printing by a sum total of the cooling time period and the time period after the cooling time period until the temperature of the fixing roller 39 is increased to around the target temperature T2. The sheet-to-sheet distance L3 is smaller than the sheet-to-sheet distance L2.

Here, if the number of pages to be printed per minute is set to be 20 ppm (page per minute) for the small-sized sheet 12 when performing the full speed printing with the sheet-to-sheet distance L2, and the number of pages to be printed per minute is set to be 16 ppm when performing the low speed printing with the sheet-to-sheet distance L3 (the printing speed is set to be ⅜ of the full speed), for example, the time consumed to continuously perform the printing job for the twenty small-sized sheets 12 is as follows.

For the full speed printing: $(60/20)\times 20=60$ seconds

For the low speed printing: $(60/16)\times 20=75$ seconds

Further, when continuously performing the printing job for the twenty small-sized sheets 12, the number of rotations of the developing roller 32, which rotates y times per second at the time of full speed printing, is as follows.

For the full speed printing: $60y$

For the low speed printing: $75\times(3/8)y=28.125y$

Like this, when performing the printing for the small-sized sheet 12, the printing speed is reduced to shorten the sheet-to-sheet distance from L2 to L3. Thereby, it is possible to reduce the number of rotations of the developing roller 32 per sheet to be printed.

Figure 8:
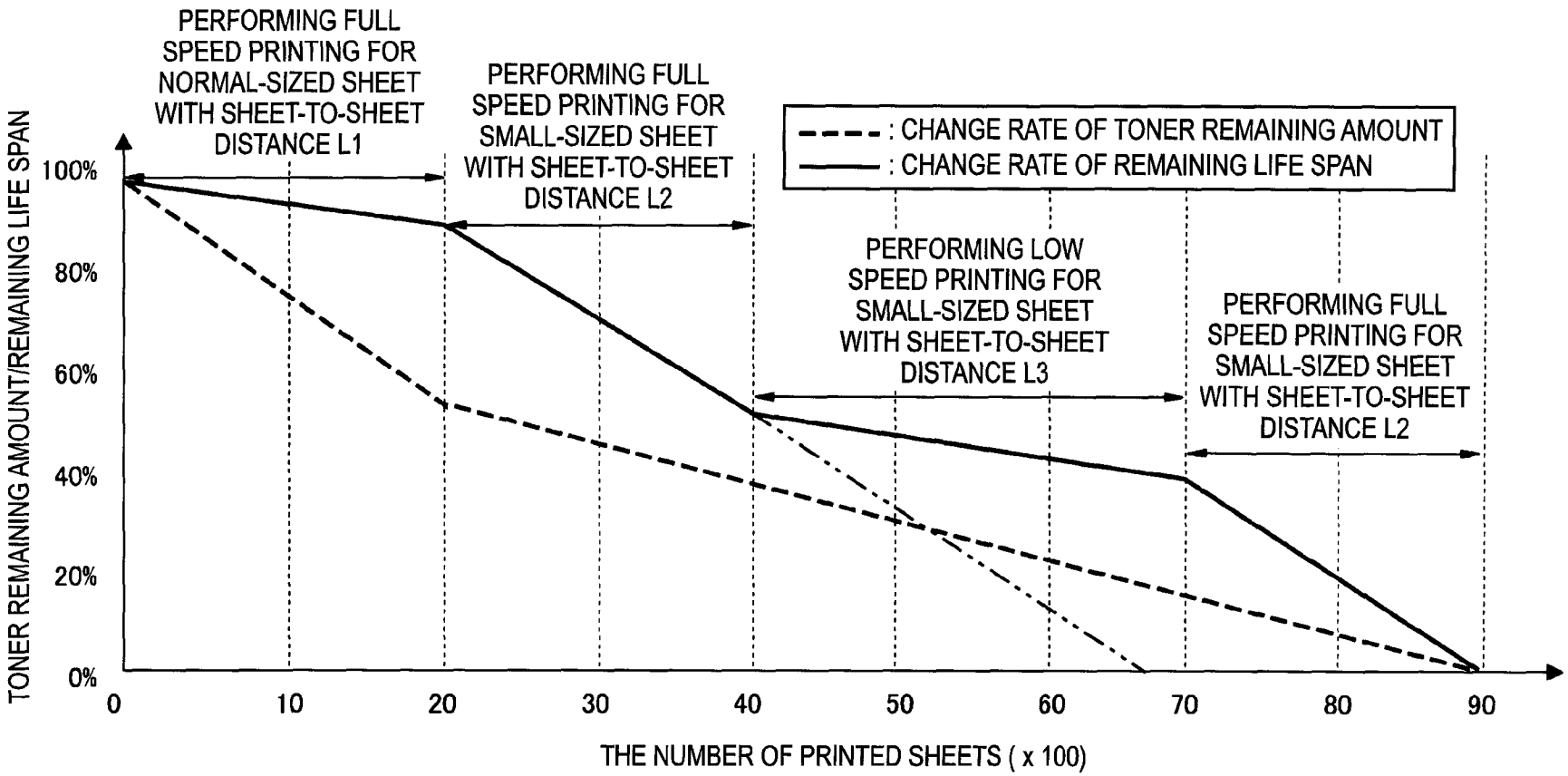
FIG. 8 is a graph showing a change rate of a remaining life span of a developing device and a change rate of a toner remaining amount with respect to the number of printed sheets.

Here, FIG. 8 is a graph showing changes of the remaining life span of the developing device and the toner remaining amount with respect to the number of printed sheets. In this example, the full speed printing is performed for the normal-sized sheet 12 with the sheet-to-sheet distance L1 from the first sheet to the 2,000th sheet.

Also, when performing the printing job for the small-sized sheet 12 from the 2,001th sheet to the 4,000th sheet, the CPU 51 compares the change rate (slope of the graph) of the remaining life span of the recent 2,000 sheets and the change rate of the toner remaining amount in S107 and sets the distance L2 as the sheet-to-sheet distance and the full speed as the printing speed because the change rate of the toner remaining amount is larger (S107: NO). In this case, as described above, since the sheet-to-sheet distance is relatively large, the number of rotations of the developing roller 32 per sheet to be printed, i.e., the driving amount of the developing device 28, is increased, compared to the normal-sized sheet, so that the remaining life span is rapidly decreased.

Then, when performing the printing job for the small-sized sheet 12 from the 4,001th sheet to the 7,000th sheet, the CPU 51 compares the change rate of the remaining life span of the recent 2,000 sheets and the change rate of the toner remaining amount in S107 and sets the distance L3 as the sheet-to-sheet distance and the low speed as the printing speed because the change rate of the remaining life span is larger (S107: YES). In this case, since the sheet-to-sheet distance is relatively small and the printing speed is also low, the number of rotations of the developing roller 32 per sheet to be printed, i.e., the driving amount of the developing device 28 is decreased, compared to the case where the full speed printing is performed with the sheet-to-sheet distance L2, so that the remaining life span is slowly decreased.

Then, when performing the printing job for the small-sized sheet 12 from the 7,001th sheet to the 9,000th sheet, the CPU 51 compares the change rate of the remaining life span of the recent 2,000 sheets and the change rate of the toner remaining amount and sets the distance L2 as the sheet-to-sheet distance and the full speed as the printing speed because the change rate of the toner remaining amount is larger (S107: YES). Thereby, the remaining life span is rapidly decreased.

In the above example, if the sheet-to-sheet distance is kept to be L2 and the printing speed is kept to be the full speed without the switching when performing the printing job for the small-sized sheet 12 from the 4,001th sheet, the remaining life span of the developing device 28 is decreased more rapidly, compared to the toner remaining amount, as shown with the dashed-two dotted line of FIG. 8. Thus, it may be necessary to replace the developing device 28 even though much toner remains.

Compared to this, according to the above printing control processing, the change rate of the remaining life span and the change rate of the toner remaining amount are compared to control the switching operation. Thereby, it is possible to suppress only one of the remaining life span and the toner remaining amount from being reduced more rapidly than the other. Therefore, until it is necessary to replace the developing device, it is possible to use the developing device 28 up to a state where the toner remaining amount becomes zero or approximates to zero. Also, until it is necessary to replace the developing device, it is possible to drive the developing device 28 up to a state where the remaining life span thereof becomes zero or approximates to zero. Thereby, it is possible to obtain the effect of reducing the processing time by the full speed printing.

(Effects of the Illustrative Embodiment)

As described above, according to this illustrative embodiment, the distance between the sheets 12 being conveyed is adjusted, based on the remaining life span of the developing device 28. Thereby, it is possible to change the driving amount of the developing device 28 and to thus adjust the life span of the developing device 28.

Also, the sheet-to-sheet distance is adjusted, based on the change rate of the toner remaining amount and the change rate of the remaining life span of the developing device in the predetermined time period (time period during which the 2,000 sheets have been recently printed). Therefore, it is possible to adjust the life span of the developing device, depending on the recent tendency.

Further, when performing the printing job for the sheet 12 having the width size smaller than the predetermined standard (here, the width size within which the sheet 12 does not extend over both end portions 39B of the fixing roller 39), the driving amount of the developing device 28 tends to be increased die to the sheet-to-sheet distance being set larger. In the invention, since the sheet-to-sheet distance is adjusted, it is possible to effectively adjust the timing when reaching the life span.

<Second Illustrative Embodiment>

Hereinafter, a second illustrative embodiment is described with reference to FIG. 9.

In this illustrative embodiment, the distance between the sheets 12 is changed at the time of printing in the printer 10 by the printer driver of the terminal apparatus 70.

Figure 9:
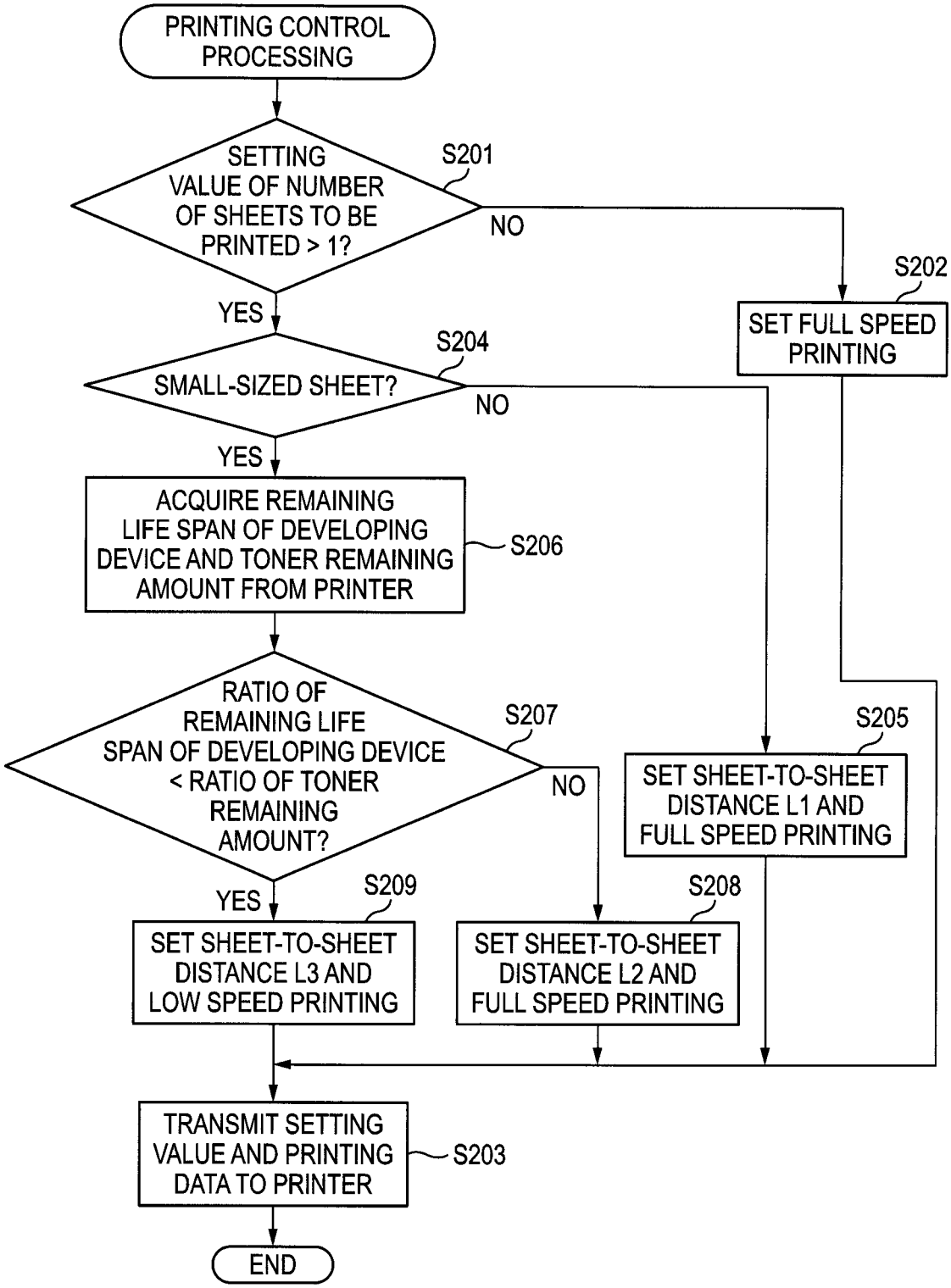
FIG. 9 is a flowchart showing printing control processing of the second illustrative embodiment.

FIG. 9 is a flowchart showing printing control processing that is executed in the terminal apparatus 70. The configurations of the printer 10 and the terminal apparatus 70 are the same as the first illustrative embodiment. Thus, in the descriptions hereinafter, the same configurations as the first illustrative embodiment are indicated with the same reference numerals and the descriptions thereof are omitted.

When a user starts an application for preparing a document or image with the terminal apparatus 70 (which is an example of the computer) and inputs an instruction to execute a printing job through the operation unit 76, the CPU 71 (which is an example of the first acquisition unit, the adjusting unit and the second acquisition unit) executes the printing control processing by the functions of the printer driver (which is an example of the program).

In the printing control processing shown in FIG. 9, the CPU 71 first determines whether the instruction is to execute a printing job for a plurality of sheets (S201). That is, in S201, the CPU 71 determines whether the setting value of the number of sheets to be printed is larger than one. When the instruction is to execute a printing for one sheet 12 (S201: NO), the CPU sets the full speed as the printing speed setting value (S202), generates printing data and transmits the printing speed setting value and the printing data to the printer 10 through the network interface 75 (S203). When the CPU 51 of the printer 10 receives the setting value and the printing data, the CPU sets the full speed as the printing speed, based on the setting values, and prints an image relating to the printing data on the sheet 12.

Also, when the instruction is to execute a printing for a plurality of sheets 12 (S201: YES), the CPU 71 of the terminal apparatus 70 determines whether the setting of the sheet size is a small size (S204). When the setting of the sheet size is a normal size (S204: NO), the CPU sets the distance L1 as the sheet-to-sheet distance setting value and the full speed as the printing speed setting value (S205) and proceeds to S203 and transmits the setting value and the printing data to the printer 10.

Also, when the setting of the sheet size is a small size (S204: YES), the CPU 71 refers to the printer 10 for the original life span and remaining life span of the developing device 28, the original toner amount and the toner remaining amount stored in the NVRAM 54 of the printer 10 through the network interface 75 and acquires the same (S206). Then, the CPU determines whether a ratio of the remaining life span to the original life span of the developing device 28 is smaller than a ratio of the toner remaining amount to the original toner amount (S207). In other words, the CPU determines whether a value obtained by subtracting the ratio of the remaining life span from the ratio of the toner remaining amount is larger than a threshold of zero (0).

When the ratio of the remaining life span of the developing device 28 is equal to or larger than the ratio of the toner remaining amount (S207: NO), the CPU 71 sets the distance L2 as the sheet-to-sheet distance setting value and the full speed as the printing speed setting value (S208) and transmits the setting values to the printer 10 together with the printing data in S203. Also, when the ratio of the remaining life span of the developing device 28 is smaller than the ratio of the toner remaining amount (S207: YES), the CPU 71 sets the distance L3 smaller than the distance L2 as the sheet-to-sheet distance setting value and the low speed as the printing speed setting value (S209) and transmits the setting values and the printing data to the printer 10 in S203. After transmitting the printing data and the like in S203, the CPU 71 ends the printing control processing.

As described above, when the ratio of the remaining life span of the developing device 28 is smaller than the ratio of the toner remaining amount, the remaining life span of the developing device 28 may be reduced more rapidly, compared to a rate with which the toner remaining amount is reduced. However, according to this illustrative embodiment, when the value obtained by subtracting the ratio of the remaining life span from the ratio of the toner remaining amount is smaller than the threshold, the distance between the sheets being conveyed is reduced to suppress the driving amount of the developing device 28 per sheet. Thereby, it is possible to extend the life span of the developing device 28.

<Third Illustrative Embodiment>

Hereinafter, a third illustrative embodiment is described with reference to FIG. 10.

In this illustrative embodiment, an intermittent printing mode where a printing job is executed whenever a printing job is received and a continuous printing mode where accumulated printing jobs of a plurality of sheets are continuously executed are switched so as to adjust the sheet-to-sheet distance.

Figure 10:
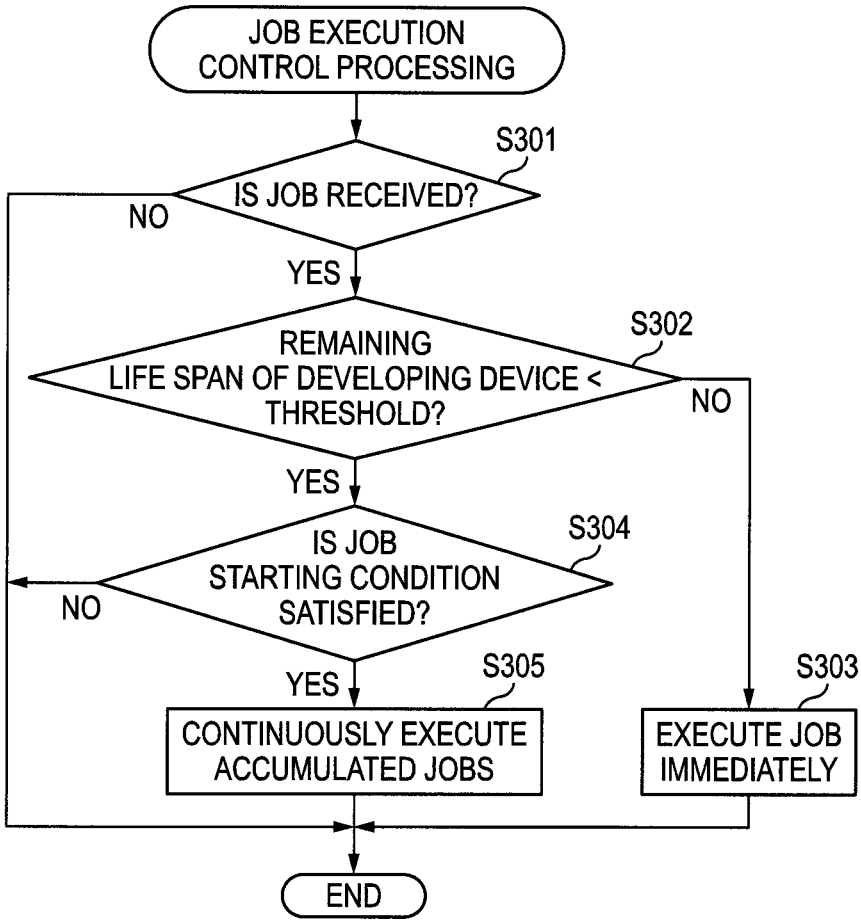
FIG. 10 is a flowchart showing job execution control processing in the third illustrative embodiment.

FIG. 10 is a flowchart showing job execution control processing that is executed in the printer 10. The configurations of the printer 10 and the terminal apparatus 70 are the same as the first illustrative embodiment. Thus, in the descriptions hereinafter, the same configurations as the first illustrative embodiment are indicated with the same reference numerals and the descriptions thereof are omitted.

As described above, when the CPU 51 receives the printing data through the network interface 56, the CPU registers the printing data on a queue that is configured on the RAM 53, as a printing job. The CPU 51 repeatedly executes the job execution control processing of controlling the execution timing of the received printing job at the state where the power supply is ON.

In the job execution control processing of FIG. 10, the CPU 51 first determines whether the printing job is received (S301). When the printing job is not received (S301: NO), the CPU ends the job execution control processing.

Also, when the printing job is received (S301: YES), the CPU 51 determines whether the remaining life span of the developing device 28 is smaller than a predetermined threshold (S302). As described above, the life span of the developing device 28 is a life span based on the driving amount of the developing device 28 and can be expressed by the number of rotations of the developing roller 32 in this illustrative embodiment. When the remaining life span of the developing device 28 is equal to or larger than the predetermined threshold (for example, 50000 and the like) (S302: NO), the CPU executes the printing job registered on the queue (S303).

In this case, the received printing job is immediately executed unless another printing job ready for execution is accumulated on the queue. Therefore, when a plurality of printing jobs is sequentially received at a time interval, an intermittent printing is performed.

Also, when the remaining life span of the developing device 28 is smaller than the predetermined threshold (S302: YES), the CPU 51 determines whether a predetermined job starting condition is satisfied (S304). When the job starting condition is not satisfied (S304: NO), the CPU ends the job execution control processing with the printing job being remained unexecuted on the queue. When the job starting condition is satisfied (S304: YES), the CPU executes the printing jobs accumulated on the queue (S305).

The job starting condition means that a total data amount of the printing data stored on the RAM 53 becomes a predetermined threshold or larger, for example. In this case, the received printing job is not executed and is accumulated until a data amount of the printing data reaches the threshold. When the data amount exceeds the threshold, the printing job accumulated on the queue is executed. Therefore, when a plurality of printing jobs is accumulated on the queue, a continuous printing of continuously printing the printing jobs is performed.

Also, the job starting condition may include a condition that the number of the registered printing jobs is two or more, a condition that predetermined time has come, a condition that the user inputs a job execution instruction through the operation unit 58, and the like, in addition to the above condition.

In the job execution control processing S303, when the plurality of printing jobs is the intermittent printing, whenever the printing job is executed, the developing device 28 is driven without the developing in most of a time period after the first sheet 12 of the printing job is sent until the sheet 12 reaches the transfer position and a time period after the last sheet 12 passes the transfer position until the sheet is discharged to the discharge tray 45.

On the other hand, when the plurality of printing jobs is the continuous printing in S305, the distance between the last sheet 12 of the printing job and the first sheet 12 of the next printing job may be set with the distance L1 when both the sheets are the normal-sized sheets 12. Therefore, it is possible to reduce the driving amount of the developing device 28, compared to the case where the plurality of printing jobs is the intermittent printing. Thus, it is also possible to suppress the rate with which the remaining life span of the developing device 28 is reduced.

As described above, according to this illustrative embodiment, when adjusting the sheet-to-sheet distance, the intermittent printing mode where the printing is executed every printing job is switched to the continuous printing mode where the plurality of accumulated printing data is continuously printed. Thereby, it is possible to reduce the sheet-to-sheet distance and to suppress the driving of the developing device 28.

<Other Illustrative Embodiments>

The invention is not limited to the above illustrative embodiments described with reference to the drawings. For example, following illustrative embodiments may be also included within the technical scope of the invention.

(1) In the above illustrative embodiments, the invention has been applied to the black-and-white printer. However, the invention is not limited thereto. For example, the invention can be also applied to a color image forming apparatus having a plurality of developing devices. In this case, the remaining life spans of the respective developing devices are compared with the standard such as threshold and toner remaining amount. When the remaining life span of any one developing device is smaller than the standard, the control may be made so that the sheet-to-sheet distance is smaller, compared to the case where the remaining life span is larger than the standard.

(2) In the above illustrative embodiments, the operation that is made when printing the printing data received from the terminal apparatus has been described. However, the invention can be also applied to a control that is performed when printing read data, which is obtained by reading out a document with a read unit, printing facsimile data received with a facsimile or printing image data read out from an internal storage medium such as HDD and an external storage medium such as memory card.

(3) In the above illustrative embodiments, the toner remaining amount of the developing device has been calculated, based on the number of printed dots. However, the invention can also use a value that is obtained by detecting the toner remaining amount with a well-known toner remaining amount sensor such as light transmission type sensor.

(4) In the first and second illustrative embodiments, the sheet sizes of two types have been used. However, according to the invention, the sheet size may be one type or three or more types and the sheet-to-sheet distance may be changed depending on the respective sizes. Also, for example, the sheet-to-sheet distance may be changed depending on sheet types such as normal sheet, thick sheet, thin sheet and the like.

(5) In the first and second illustrative embodiments, the sheet-to-sheet distance is changed in two steps. However, according to the invention, the sheet-to-sheet distance may be changed in three or more steps. For example, when the value obtained by subtracting the ratio of the toner remaining amount from the ratio of the remaining life span of the developing device is −10%, 0% or 10%, the sheet-to-sheet distance may be changed to 10 cm, 5 cm or 2.5 cm, for example. At this time, the printing speed may be also changed to full speed, ½ speed or ¼ speed. Like this, the smaller the value obtained by subtracting the ratio of the remaining life span of the developing device from the ratio of the developer remaining amount, the sheet-to-sheet distance is reduced. Thereby, it is possible to suppress the driving amount of the developing device per sheet and to prolong the life span thereof.

(6) In the first and second illustrative embodiments, the determination with respect to the setting of the sheet-to-sheet distance is made every printing job. However, the invention is not limited thereto. For example, the determination may be made whenever one sheet is printed or 500 sheets are printed. Alternatively, the determination may be made every predetermined time period. Also, when comparing the remaining life span and the change rate of the toner remaining amount in the time period during which 1,000 sheets have been recently printed, the comparison may be made in a time period during which the printing has been made from 6,001th sheet to 7,000th sheet when a 7,001th sheet is printed and in a time period during which the printing has been made from 6,002th sheet to 7,001th sheet when a 7,002th sheet is printed. Like this, the remaining life span and the change rate of the toner remaining amount may be compared whenever one sheet is printed and the sheet-to-sheet distance may be set depending on a result of the comparison.

(7) In the third illustrative embodiment, it is determined whether the printing job is immediately executed or accumulated in a unit of one printing job. However, the invention is not limited thereto. For example, when it takes to receive the printing data of one page and one page or to process an image, it may be switched to individually print a page whenever printing data of one page is obtained or to continuously print a plurality of pages after printing data of the plurality of pages is obtained.

(8) The condition determinations of the respective flowcharts shown in FIGS. 3, 9 and 10 are just exemplary and the other appropriate determinations may be also possible. For example, the step S107 of FIG. 3 or S207 of FIG. 9 may be replaced with the determination of the step S302 of FIG. 10 where the remaining life span of the developing device is compared with the threshold. To the contrary, the determination in S302 of FIG. 10 may be made, based on the remaining life span and the toner remaining amount, like the step S107 of FIG. 3 or S207 of FIG. 9.

(9) In the first illustrative embodiment, the change rate of the remaining life span and the ratio of the color printing are calculated in the time period during which the predetermined number of sheets has been recently printed. However, for example, the change rate of the remaining life span and the like may be also calculated in a recent month. Alternatively, the change rate of the remaining life span and the like may be calculated from the beginning of use of the developing device to the current.

(10) In the above illustrative embodiments, the first acquisition unit, the adjusting unit and the second acquisition unit are implemented by the same CPU. However, they may be configured by different CPUs, ASICs or other circuits.

What is claimed is:

1. An image forming apparatus comprising:

a conveyance unit configured to convey a sheet;

a printing unit configured to drive a developing device accommodating developer therein, supply the developer from the developing device to a photosensitive member having an electrostatic latent image formed thereon to thus form a developer image, and transfer the developer image onto the sheet, in accordance with the conveyance of the sheet by the conveyance unit;

a first acquisition unit configured to acquire a remaining life span of the developing device based on a driving amount of the developing device; and an adjusting unit configured to adjust a distance between the sheets being conveyed by the conveyance unit based on the remaining life span of the developing device acquired by the first acquisition unit.

2. The image forming apparatus according to claim 1, wherein the adjusting unit adjusts the distance between the sheets to be smaller when the remaining life span of the developing device becomes smaller.

3. The image forming apparatus according to claim 1, further comprising a second acquisition unit configured to acquire a remaining amount of the developer in the developing device, wherein the adjusting unit adjusts the distance between the sheets to be smaller when a value which is obtained by subtracting a first ratio of the remaining life span of the developing device to an original life span of the developing device from a second ratio of the remaining amount of the developer to an original amount of the developer becomes smaller.

4. The image forming apparatus according to claim 1, wherein the adjusting unit adjusts the distance between the sheets based on a change rate of the remaining amount of the developer and a change rate of the remaining life span of the developing device during a predetermined time period.

5. The image forming apparatus according to claim 4, wherein the printing unit includes a fixing device configured to press the sheet having the developer image formed thereon to an outer periphery of a heated fixing roller, thereby fixing the developer image, and wherein, when a printing job is performed for a sheet having a width size smaller than a predetermined standard, the adjusting unit adjusts the distance between the sheets.

6. The image forming apparatus according to claim 5, wherein the adjusting unit reduces a conveyance speed of the sheet by the conveyance unit in accordance with the reduction of the distance between the sheets.

7. The image forming apparatus according to claim 6, wherein, when adjusting the distance between the sheets, the adjusting unit switches between an intermittent printing mode of performing printing for each predetermined unit of printing data respectively and a continuous printing mode of continuously performing printing for a plurality of the predetermined unit of printing data.

8. The image forming apparatus according to claim 7, wherein the developing device includes a developing roller, and wherein the first acquisition unit acquires the remaining life span of the developing device based on a number of rotations of the developing roller.

9. The image forming apparatus according to claim 1, wherein the printing unit includes a fixing device configured to press the sheet having the developer image formed thereon to an outer periphery of a heated fixing roller, thereby fixing the developer image, and wherein, when a printing job is performed for a sheet having a width size smaller than a predetermined standard, the adjusting unit adjusts the distance between the sheets.

10. The image forming apparatus according to claim 1, wherein the adjusting unit reduces a conveyance speed of the sheet by the conveyance unit in accordance with the reduction of the distance between the sheets.

11. The image forming apparatus according to claim 1, wherein, when adjusting the distance between the sheets, the adjusting unit switches between an intermittent printing mode of performing printing for each predetermined unit of printing data respectively and a continuous printing mode of continuously performing printing for a plurality of the predetermined unit of printing data.

12. The image forming apparatus according to claim 1, wherein the developing device includes a developing roller, and wherein the first acquisition unit acquires the remaining life span of the developing device based on a number of rotations of the developing roller.

13. A computer readable storage device having a computer program stored thereon and readable by a computer, which is connected to an image forming apparatus including a conveyance unit configured to convey a sheet; and a printing unit configured to drive a developing device accommodating developer therein, supply the developer from the developing device to a photosensitive member having an electrostatic latent image formed thereon to thus form a developer image, and transfer the developer image onto the sheet, in accordance with the conveyance of the sheet by the conveyance unit; the computer program, when executed by the computer, causes the computer to perform operations comprising:

acquiring a remaining life span of the developing device based on a driving amount of the developing device, and adjusting a distance between the sheets being conveyed by the conveyance unit based on the acquired remaining life span of the developing device.

14. An image forming apparatus comprising:

a conveyance unit configured to convey sheets while leaving a distance between the sheets;

a printing unit configured to drive a developing device accommodating developer therein, supply the developer from the developing device to a photosensitive member having an electrostatic latent image formed thereon to thus form a developer image, and transfer the developer image onto the sheet, in accordance with the conveyance of the sheet by the conveyance unit;

a first calculating unit configured to calculate a change rate of a remaining life span of the developing device based on a driving amount of the developing device;

a second calculating unit configured to calculate a change rate of a remaining amount of the developer in the developing device; and an adjusting unit configured to:

adjust the distance between the sheets conveyed by the conveyance unit to a first distance if a size of the sheets are larger than a predetermined size, adjust the distance between the sheets conveyed by the conveyance unit to a second distance, which is smaller than the first distance, if the size of the sheets are not larger than the predetermined size and the change rate of the remaining life span of the developing device is not larger than the change rate of the remaining amount of the developer, and adjust the distance between the sheets conveyed by the conveyance unit to a third distance, which is smaller than the second distance, if the size of the sheets are not larger than the predetermined size and the change rate of the remaining life span of the developing device is larger than the change rate of the remaining amount of the developer.

* * * * *